US005516005A

United States Patent [19]

Moseley

[11] Patent Number: 5,516,005

[45] Date of Patent: May 14, 1996

[54] WRIST-WATCH DEFENSE DEVICE

[76] Inventor: William W. Moseley, 23, Five Points Rd., Mertztown, Pa. 19539

[21] Appl. No.: 321,449

[22] Filed: Oct. 12, 1994

[51] Int. Cl.[6] ..... B67D 5/00

[52] U.S. Cl. ..... 222/3; 63/1.1; 222/23; 222/153.14; 222/192; 222/509; 222/518

[58] Field of Search ..... 222/3, 23, 153.14, 222/192, 153.13, 509, 518; 63/1.1, 3, 21

[56] References Cited

U.S. PATENT DOCUMENTS

| | | | |
|---|---|---|---|
| 1,073,312 | 9/1913 | Woods . | |
| 1,663,834 | 3/1928 | Goss . | |
| 1,772,070 | 8/1930 | Darley . | |
| 2,728,486 | 12/1955 | Scherer | 222/23 |
| 3,018,578 | 1/1962 | Hill | 42/13 |
| 3,084,466 | 4/1963 | Duncan, III | 42/1 |
| 3,109,253 | 11/1963 | Eig | 42/1 |
| 4,135,645 | 1/1979 | Kimmell | 222/83 |
| 4,223,804 | 9/1980 | Morris et al. | 222/3 |
| 4,241,850 | 12/1980 | Speer | 63/1.1 X |
| 4,786,248 | 11/1988 | Nitta | 222/153.14 X |
| 4,986,444 | 1/1991 | Corso | 222/23 |
| 5,318,492 | 6/1994 | Quinn | 482/108 |
| 5,366,118 | 11/1994 | Ciammitti | 222/153.14 X |

FOREIGN PATENT DOCUMENTS

| | | | |
|---|---|---|---|
| 2518774 | 6/1983 | France | 222/192 |
| 682290 | 8/1993 | Switzerland | 63/3 |

*Primary Examiner*—Joseph A. Kaufman
*Attorney, Agent, or Firm*—Terrance L. Siemens

[57] ABSTRACT

A defense device, mounted on a wrist watch and made part of it, has a gas chamber underneath the wrist watch. The chamber, containing pressurized repellant gas, is locked to the watch with an interlocking ring between the watch and the gas chamber. The gas can be released by a user by pushing a trigger end of a pin to actuate the release of the gas at the other end, where a nozzle discharges the gas sideways in a wide spray impinging on an incoming attacker. The invention is formed to blend inconspicuously with the design of the watch, so as to prevent the incoming attacker from knowing of the device. A user of the device may pretend to read the time, while in reality releasing the repellant gas from the side of the hand to the incoming attacker. The interlocking ring has an aperture at the top to accommodate a wrist watch, and an aperture at the bottom to accept a matching gas chamber and lock it into position, ready for firing.

4 Claims, 3 Drawing Sheets

WRIST-WATCH DEFENSE DEVICE

BACKGROUND OF THE INVENTION

1. Field of the Invention

The present invention relates to a defense device capable of repelling potential assailants. More specifically, it relates to a device which is mountable on a wristwatch, and capable of ejecting on demand a spray of repellent gas such as to repel an incoming attacker. As such, the fields of self-defense and personal security are the most likely to benefit from the unique advantages of the instant invention.

2. Description of the Prior Art

Several defense devices have been offered in the past in the patent literature, for the purpose of effecting a similar role of deterring an assailant, but, as will be seen, none of the prior art devices perform in the same manner as the present invention.

U.S. Pat. No. 5,318,492, issued to John M. Quinn on Jun. 7, 1994, discloses a jogging weight with repellent chemical imbedded therein. This device is such as to be hand-held by the user while walking or jogging. He can fire the deterrent gas by the push of a button. It requires a heavy and bulky hand-held auxiliary carrier of the repellent gas. It is therefore not like the present device, which is light and made as if it was part of a wrist watch.

U.S. Pat. No. 4,223,804, issued to Bob H. Morris et al. on Sep. 23, 1980, describes a personal defense device combining a flashlight with a cylinder capable of ejecting a noise-making, dye-carrying or odoriferous gas. The device is hand carried and triggered upon command. Again, this device must be carried by hand, whereas for the present invention both hands remain free.

U.S. Pat. No. 4,135,645, issued to Steven Kimmell et al, on Jun. 23, 1979, proposes a self-defense ring, which is installed on a finger, and which can emit a chemical substance. The ring is really not inconspicuous, because it has a superstructure which betrays its purpose. By contrast, the present device remains inconspicuous at all times.

A defensive weapon is the subject of U.S. Pat. No. 3,109,253, issued to Saul Eig on November 1963. This device takes the shape of a cigarette lighter for deceiving the attacker. It can discharge a stream of gas to deter an incoming attacker. Again, this device requires that the hand be tied when the device is in use.

Another patent, U.S. Pat. No. 3,084,466, issued to Joseph Gray Duncan et al. on Apr. 9, 1963, discloses a weapon of self defense, in the shape of a ball-point pen, or lipstick holder, and capable of ejecting a lachrymal substance. In the case of a lipstick holder, the device is meant to be carried by a woman, who then effects a turning of a sleeve, which she is naturally accustomed to do during make-up, thereby releasing the gas. The user must carry the device in his/her hand when using it, whereas the present device is automatically carried as part of the wrist watch.

U.S. Pat. No. 3,018,578, issued on Jan. 30, 1962 to Edward T. Hill, describes a pistol to be worn on the wrist. This device could also be used to fire a deterrent gas. This device does not immobilize the hand as most of the above-referenced patented devices do, and would therefore attempt to fulfill the requirement of keeping the hand free, but is so bulky as to give away information about the user's intentions, while the present device remains inconspicuous.

Another U.S. Pat. No. 1,772,070, issued to William S. Darley on Aug. 5, 1930, discloses a device in the shape of a fountain pen, capable of discharging a tear gas, by releasing a spring activated plunger which then strikes a gas-carrying cartridge, thereby releasing the gas. This has the same drawback most of the above-referenced devices have, i.e., it must immobilize one hand.

A similar device, covered by U.S. Pat. No. 1,663,834, issued to Byron C. Goss on Mar. 27, 1928, describes a fountain-pen shaped pistol, capable of ejecting a gas by releasing a firing pin onto an internal cylinder. Again, the same comment applies as to immobilizing the hand.

Finally, U.S. Pat. No. 1,073,312, issued to Leonard Woods, on Nov. 4, 1912, discloses a pistol in the shape of a vest-pocket watch, adapted to be fired without arousing the suspicion of the attacker, as if the user just wanted to read the time. The would-be watch must however require the user to pull it from a vest pocket and therefore must occupy one of his hands in so doing.

None of the above inventions and patents, taken either singly or in combination, are seen to describe the instant invention as claimed.

SUMMARY OF THE INVENTION

Briefly, the invention provides for carrying a gas chamber mounted under a wrist watch by a suitable interlocking ring, and a pin to trigger the ejection of a tear gas. The ring has an opening at its top, so that a conventional wrist watch may be seated to said ring from the top. The ring has a specially shaped aperture cut from its bottom, so that the ring can accommodate a gas/propellant chamber by a 90 degree turn of the gas chamber with respect to the ring, so as to lock it into position. Once installed and carried by the user, the gas can easily be triggered by pushing a trigger portion of a pin accessed from a side of the watch. The gas chamber, opposite the side of the trigger portion of the pin, has a nozzle for releasing the gas. The pin, by being thin, hard, and long in shape, then actuates the release of the gas at the nozzle end of the chamber. The nozzle is disguised as a part of the watch, so as to avoid disclosure of its intended purpose. If necessary, the chamber can be designed to extend the watch design in color and shape, so as to give appearance that it is part of the watch itself. The chamber can be loaded with red pepper gas, or by any other suitably odoriferous or repellant gas.

Alternatively, the interlocking ring can be adhered to the bottom of an existing watch, and the gas/propellant chamber mounted to said ring, by a quarter turn of the gas chamber into said ring to provide a locked position.

In addition, small, pressure-loaded springs can be affixed to the interlocking ring to snap the ring into the locked position with respect to the gas chamber.

Another design of the interlocking ring could be made to offer a hole at both the top and bottom, so that both watch and gas chambers can be accommodated and locked into position, each by a quarter turn with respect to said ring. In this configuration a top hole in the interlocking ring can be made to fit snugly on top of the watch bezel.

Accordingly, it is the principal object of the invention to provide a new and improved way to deter an attacker from assaulting an intended victim.

It is also the principal object of this invention to provide a means of inconspicuously ejecting a lachrymal gas from a wristwatch position, while retaining the useful role of the wrist watch as a time keeping device.

It is another object of the invention to provide safety in the operation of the tear-gas mechanism by providing an auxiliary button, designed to free the operation of the firing pin only when the user is ready to fire.

It is a secondary object of the present invention to provide a ring with cutouts at both its top and bottom, so that both the watch and gas chamber can each be locked to said ring by a 90 degree turn.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, wherein.

DETAILED DESCRIPTION OF THE PREFERRED EMBODIMENTS

Figure 1:
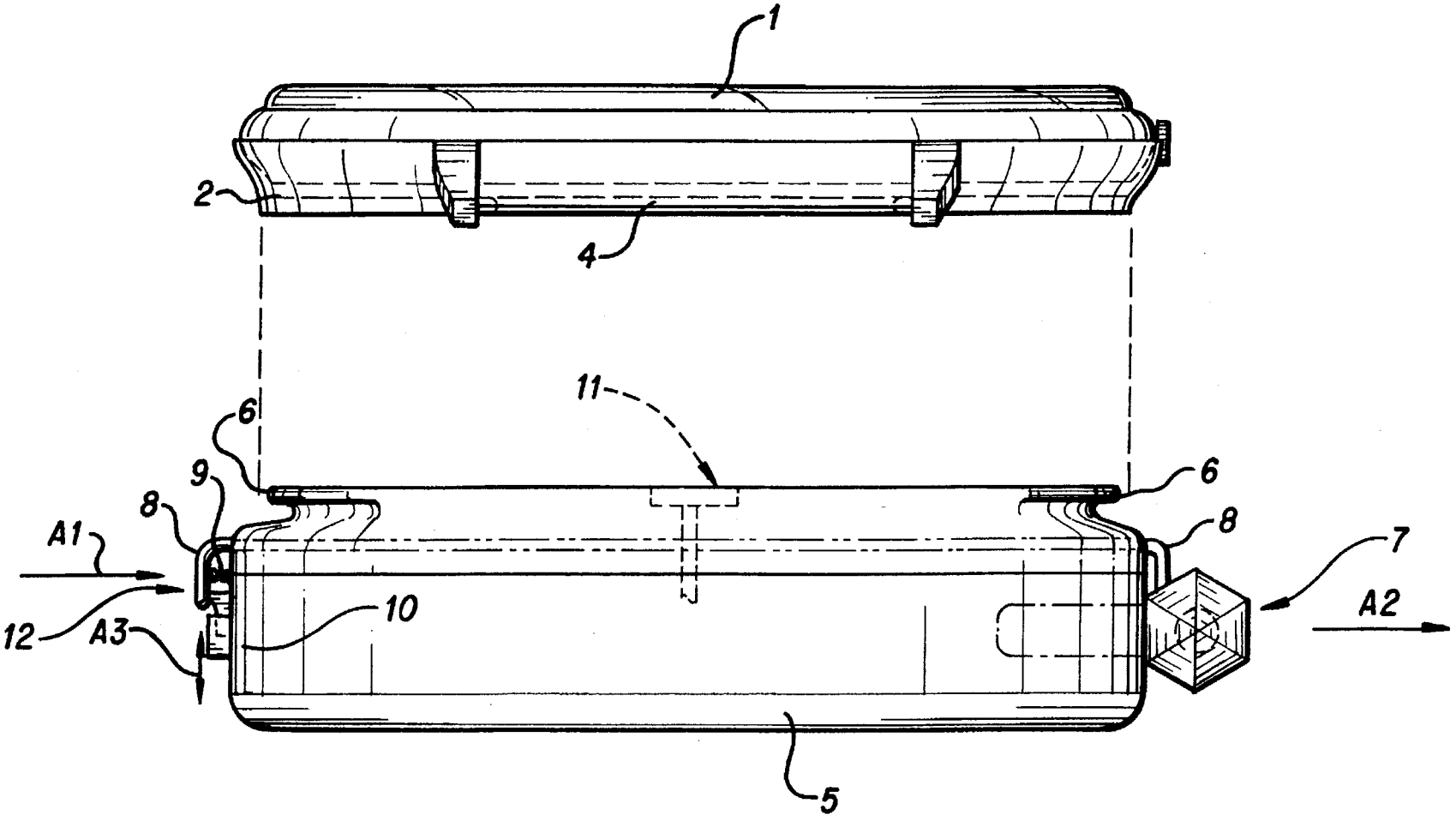
FIG. 1 is a side view of a preferred embodiment of the invention showing the watch portion lifted from the gas chamber portion.
Figure 3:
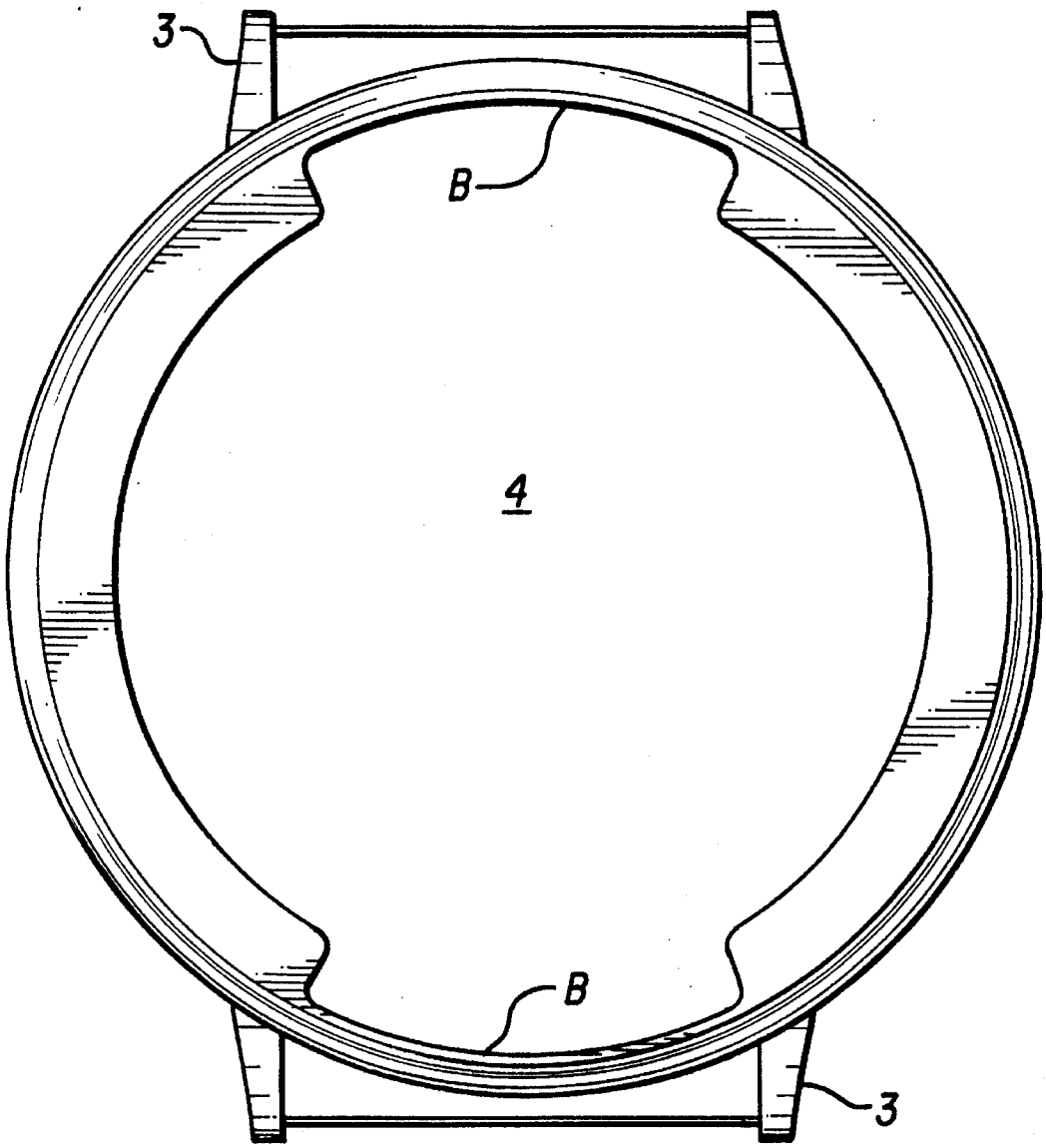
FIG. 3 is a bottom view of the watch with an interconnected locking ring showing a generally circular aperture for seating the watch to the gas chamber.

FIG. 1 shows watch 1 seated on ring 2 from the top. Ring 2 has a watch band connector 3 on diametrically opposite sides. The artisan will recognize that the watch band connectors 3 could as well be connected directly to an existing watch's sides and extend through appropriate cutouts in the ring. An aperture 4 with two bays B, best seen in FIG. 3, is formed in the bottom of ring 2 and permits insertion of matching lips or tabs 6 on gas chamber 5. Tabs 6 fit in bays B so as firmly fit chamber 5 to ring 2 by twisting the two elements a quarter turn with respect to one another. Protruding lips 6 are such as to fit through the cutout bays in 4 during insertion, and to be held in the locked position when the chamber is inserted from the bottom and rotated 90 degrees with respect to the ring.

Pressurized gas is released from nozzle 7 by pushing trigger portion 12 of pin 8 so as to move nozzle 7 located on the opposite side. Arrows A1 and A2 indicate the direction of movement in normal operation. A return spring 9 returns the pin to its original position once the pushing force is removed. A safety button 10 prevents the accidental or unintended use of the device. Button 10 can be slid beneath trigger portion 12 of pin 8 in the direction of arrows A3. A pressure indicator 11 gauges the pressure level of gas supply remaining in the chamber.

Figure 2:
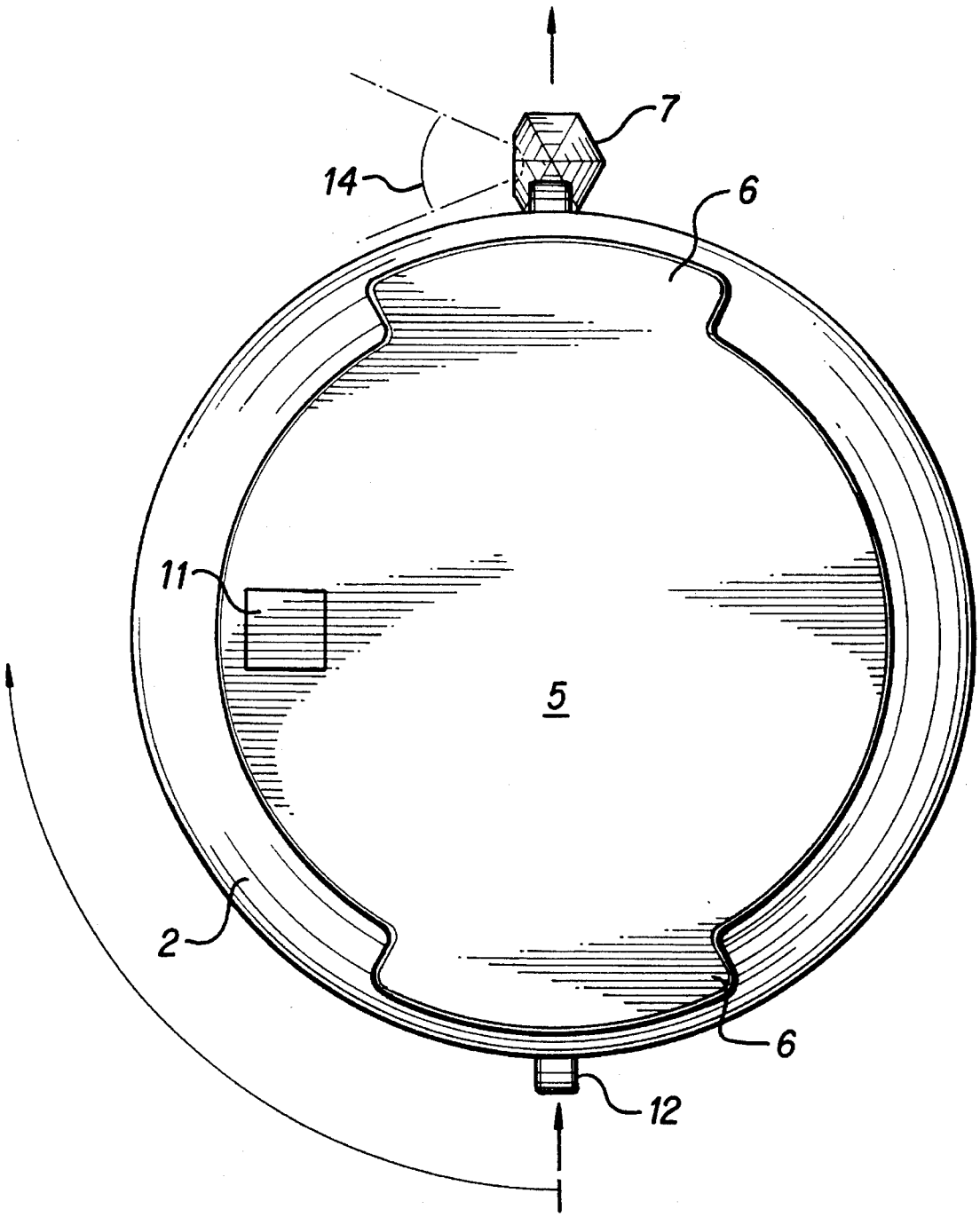
FIG. 2 is a top plan view of the gas chamber with the interlocking mechanism for mounting the watch bottom.

FIG. 2 shows the lips 6 of pressure chamber 5 and the trigger 12 as seen from the top. The jet spray pattern 14 exiting nozzle 7 can be seen as going to the left of the watch in the figure. This assumes of course that the watch is mounted on the left wrist for a right-handed individual. For a left-handed person, the jet will exit to the right. It is also possible to provide, under the scope of the present invention, a nozzle adjustable for either a right-handed or left-handed individual, by rotating the nozzle and providing two stop positions, one ejecting to the left, and the second one ejecting to the right.

FIG. 3 shows the bottom of the watch with ring 2 and its opening 4 with bays B for attaching the watch to the cooperating tabs 6 on the pressurized gas chamber 5. It should be noted that ring 2, with its cooperating attachment structure can be formed as an integral part of the watch casing or can be shaped so as to receive (as with adhesives) a conventional watch casing for attachment above the pressurized gas chamber of this invention.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications to the invention in order to adapt it to various usages and conditions. For example, the artisan could easily provide for a micro-calculator to be included with the watch and gas chamber, and design the shape and size of the ring to accommodate this situation.

It is to be understood that the present invention is not limited to the sole embodiment described above, but encompasses any and all embodiments within the scope of the following claims:

I claim:

1. A self-defense device for use in combination with and mounted on a wrist watch, said self-defense device having means for discharging a repellent gas at an assailant, said self-defense device comprising:

an interlocking ring for attaching said self-defense device to the wrist watch, comprising a lateral wall partially surrounding said watch, and means for releasably engaging the wrist watch; and a receptacle for storing pressurized repellent gas, said receptacle disposed adjacent to the wrist watch, said receptacle having means for releasably engaging said interlocking ring by interlocking said receptacle and said locking ring by relative rotation, and ejection means for controllably releasing and directing repellent gas from said receptacle towards the assailant.

2. The self-defense device according to claim 1, wherein said ejection means comprises:

a nozzle for ejecting repellent gas, a pin for actuating said nozzle, said pin passing through said receptacle, said pin movable to a position actuating said nozzle and also movable to an original position not actuating said nozzle, a spring for returning said pin to said original position, and a safety button movable to a position preventing use of said self-defense device.

3. The self-defense device according to claim 1, further comprising a pressure gauge for indicating when repellent gas contained within said receptacle is nearing exhaustion.

4. The self-defense device according to claim 1, said means for releasably engaging said interlocking ring further comprising tabs attached to one of said receptacle and said interlocking ring, and means defining bays formed in the other of said receptacle and said interlocking ring, said tabs penetrating and occupying said bays when said receptacle and said interlocking ring are rotated relative to one another.

* * * * *